US007913502B2

(12) United States Patent
Robin

(10) Patent No.: US 7,913,502 B2
(45) Date of Patent: Mar. 29, 2011

(54) EXPANSION VALVE AND METHOD FOR ITS CONTROL

(75) Inventor: Jean-Jacques Robin, Berglen (DE)

(73) Assignee: Otto Egelhof. GmbH & Co. KG, Fellbach (DE)

( * ) Notice: Subject to any disclaimer, the term of this patent is extended or adjusted under 35 U.S.C. 154(b) by 1476 days.

(21) Appl. No.: 11/255,595

(22) Filed: Oct. 21, 2005

(65) Prior Publication Data

US 2006/0086116 A1 Apr. 27, 2006

(30) Foreign Application Priority Data

Oct. 22, 2004 (DE) ..... 10 2004 051 538
Jan. 27, 2005 (DE) ..... 10 2005 003 968

(51) Int. Cl.
*F25B 41/04* (2006.01)

(52) U.S. Cl. ..... 62/222

(58) Field of Classification Search ..... 62/222, 62/511; 137/493.8
See application file for complete search history.

(56) References Cited

U.S. PATENT DOCUMENTS 2,993,341 A * 7/1961 Newton ..... 62/77
3,613,391 A * 10/1971 Harter ..... 62/184
7,487,647 B2 2/2009 Robin et al.

FOREIGN PATENT DOCUMENTS

DE 100 12 714 A1 9/2001
DE 102 19 667 A1 11/2003

* cited by examiner

*Primary Examiner* — Melvin Jones
(74) *Attorney, Agent, or Firm* — Kriegsman & Kreigsman

(57) ABSTRACT

The invention relates to an expansion valve and a method for controlling an expansion valve, in which the opening and closing movement of the valve-closing element is adjusted as a function of the pressure difference which is present on the high-pressure side in an inlet opening and on the low-pressure side in an outlet opening.

23 Claims, 9 Drawing Sheets

EXPANSION VALVE AND METHOD FOR ITS CONTROL

BACKGROUND OF THE INVENTION

1. Field of the Invention

The invention relates to an expansion valve and a method for its control, in particular in the form of vehicle air-conditioning systems operated with $CO_2$ as the cooling medium which have a valve housing with an inlet opening and an outlet opening and with a valve element which is displaceable out of a valve seat of a flowthrough opening, which is arranged between the inlet opening and the outlet opening, for the flowthrough of the cooling medium.

2. Related Art

For cooling medium circuits of air-conditioning systems of future motor vehicles, carbon dioxide ($CO_2$) is preferred as the cooling medium, as this substance ensures a high degree of accident safety owing to its incombustibility and moreover is not regarded as a harmful substance for the environment. In contrast to the R134a cooling circuit, operation for $CO_2$ cooling circuits takes place in the supercritical range as well.

An expansion valve which is used in cooling medium circuits of air-conditioning systems with $CO_2$ is known from DE 100 12 714 A1. This expansion valve has a throttling opening with a fixed cross section in order to transfer the cooling medium from the high-pressure side to the low-pressure side for pressure relief. This cross section is always open for flowing through. If overpressure arises on the high-pressure side in the cooling medium circuit, a bypass valve connected parallel to the throttling opening is opened, so that the overpressure in excess of the optimum high pressure is reduced. The bypass valve opens only when a predetermined threshold value is exceeded on the high-pressure side.

This arrangement constitutes a functionally reliable design of an expansion valve, but it is necessary for the setting of both the threshold value and the orifice diameter to be adapted to the air-conditioning system concerned in order to achieve a maximum performance coefficient over the entire range of application of the air-conditioning system.

An expansion valve with an electronic control which has an electrically operable device for displacing a valve element is known from DE 102 19 667 A1, a further throttling location, assigned to this first throttling location in series, being provided, the passage cross section of which can be adjusted in combination with the passage cross section of the first throttling location. By virtue of this series connection of at least two throttling locations, at least one being activatable by an electric solenoid valve, the pressure difference at each individual throttling location becomes smaller than in the case of only one throttling location. This increases the control accuracy. In particular, the variations arising in the pressure difference between summer and winter can be offset.

However, this solution has the disadvantage that a costly construction is necessary. The activation of the solenoid valve requires the use of a pressure and temperature sensor or a control box with software in the control circuit, as a result of which this expansion valve is costly to manufacture and to assemble.

BRIEF SUMMARY OF THE INVENTION

The object of the invention is therefore to propose an expansion valve, and also a method for controlling the expansion valve, which is cost-effective to manufacture and assemble and also to make possible simple activation for operation of the cooling medium circuit in which optimum high pressure is to the greatest extent possible present before the expansion valve.

According to the invention, this object is achieved by a method according to claim 1.

According to the invention, the pressure difference between the inlet pressure present in the inlet opening on the high-pressure side and the outlet pressure present in the outlet opening on the low-pressure side of the cooling medium circuit is used in order to control the opening or closing movement of the valve element. In this connection, the pressure conditions actually prevailing in the cooling medium circuit are used in order to bring about opening and closing of the valve element, by way of which a mass flow flowing through the expansion valve is controlled.

For lower ambient temperatures, such as for example in autumn and winter, the high pressure at the inlet of the expansion valve is between 50 and 70 bar, while in summer the high ambient temperatures make a high pressure of between 100 and 120 bar necessary. The low pressure remains between 35 and 45 bar in winter as in summer. By precise activation of the valve-closing element via the differential pressure, energetically optimum proportioning of the cooling medium mass flow takes place independently of the absolute pressures at the inlet of the expansion valve.

According to an advantageous development of the invention, an opening cross section between the valve-closing element and the valve seat changes continuously as a function of the pressure difference. The change in the pressure difference affects the change in the opening cross section of the valve directly, so that direct control of the mass flow is afforded. By virtue of this, the pressure drop across the entire expansion valve or the high pressure to be set optimally can be brought in the desired way on the basis of the actual conditions.

According to a further advantageous development of the method, the opening time for the through-bore is set by a restoring device acting counter to the opening direction of the valve-closing element. By virtue of this, fine tuning can be made possible in order additionally to adjust the pressure difference range from which the valve-closing element is opened.

According to the invention, the object forming the basis of the invention is achieved by an expansion valve in which a required mass flow flowing through the valve for operation of the cooling medium circuit with optimum high pressure is determined from the inlet pressure in the inlet opening, the outlet pressure in the outlet opening and the temperature before the valve-closing element, from which the required valve opening cross section can be inferred. The use of these parameters for determining the valve opening cross section makes it possible for the desired mass flow to flow through the expansion valve as a function of the pressure difference as the pressure difference in turn determines the opening and closing movement of the valve-closing element. This makes it possible for the optimum high pressure to be achieved and maintained in the supercritical range, that is for ambient temperatures greater than roughly 27° C. In the subcritical range, a smaller valve opening cross section appears owing to the lower condensation pressure in the external heat exchanger, which comes close to energetically optimum operation. This leads to an increase in the coefficient of performance (COP), which is defined from the relationship between the cooling performance, that is the quantity of heat on the evaporator side, and the work performance for the compressor. This performance coefficient has an optimum in both subcritical and supercritical operation which is essentially dependent on the cooling medium temperature after the external heat exchanger or also on the ambient temperature, that is on the air temperature at the inlet of the external heat exchanger. The energetically optimum operating mode is achieved when the maximum cooling performance is brought about for the smallest possible input power. To achieve an optimum COP in the subcritical range, the expansion valve should close to such an extent that a small degree of undercooling occurs at the external heat exchanger. If the valve opening is set larger, the COP worsens increasingly as the cooling medium mass flow and consequently the input power of the compressor rises, or the available evaporation enthalpy falls. If the expansion valve closes too much, that is the opening cross section is reduced too much, the high pressure rises on account of the smaller mass flow, as does the compressor input power. In this case, however, a more rapid worsening of the COP is to be noted, as illustrated in FIG. 4*b*, for example.

The transcritical range is characterized by precisely the opposite behaviour. Starting from an optimum COP, which is achieved for a given high pressure, a reduction of the valve cross section leads directly to an increase in the high pressure and a fall in the COP. In the other direction, a valve cross section increase leads to a fall in the high pressure and the COP. In this direction, however, the worsening of the COP is considerably more marked.

The object forming the basis of the invention is furthermore achieved according to the invention by an expansion valve in which an opening force which results from a pressure difference between an inlet pressure of the inlet opening and an outlet pressure of the outlet opening moves a valve-closing element in the opening direction counter to the restoring device. This expansion valve is activated by the opening force resulting from the pressure difference, by virtue of which adaptation of the mass flow flowing through the expansion valve to the ambient conditions actually prevailing is made possible without electric support.

According to an advantageous development of the invention, the opening direction of the valve-closing element is provided in the flow direction of the cooling medium. By virtue of this, favourable flow properties can be created, the result of which is a reduction in friction losses or turbulence during flow through the throttling location or the through-opening.

According to a preferred development of the invention, the valve-closing element has a closing body which is provided on the outlet-pressure side in relation to the valve seat and extends on the inlet-pressure side through a through-opening. By virtue of this, simpler construction of the valve-closing element is afforded, which makes possible continuous change in the opening cross section by way of the relative movement in relation to the valve seat.

Advantageously, the valve-closing element has a closing body which comprises a conical closing surface. By virtue of this, a continuous increase in the opening cross section can be achieved during an opening movement of the valve-closing element. Furthermore, provision can alternatively be made that the conical closing surface is designed with a convexly or concavely curved lateral surface. By virtue of this, it is possible to control mass flows for pressure relief as a function of the high-pressure-side working points, so that a non-linear change in the opening cross section for the mass flow is afforded as a function of the travel. The external geometries of the closing body and of the valve seat are adapted to the desired volumes of the mass flow at the working pressures concerned, which are to be adjusted as a function of the opening movement in order to achieve optimum high-pressure operation.

According to a further advantageous development of the invention, the closing body of the valve-closing element is surrounded by a nozzle opening of a nozzle device, which has a greater opening width than the peripheral surface of the outlet-pressure-side closing body. By virtue of this, a free flow-off and flowthrough of the through-opening is achieved. At the same time, the valve-closing element can be held captive in the nozzle device via the valve seat. Alternatively, provision can also be made that the valve-closing element is arranged exclusively on the inlet-pressure side or on the outlet-pressure side, the restoring device being arranged in a corresponding way in order to keep the through-opening closed when pressure compensation takes place or at a determinable small pressure difference.

According to an advantageous embodiment of the invention, the valve element is guided in a nozzle device by a guide portion and positioned opposite the latter in a valve seat. This configuration of the nozzle device makes it possible to construct the expansion valve with a small number of components. This nozzle device can advantageously be pressed in, clamped in, screwed in or the like in the housing.

The mass flow is advantageously admitted between the guide portion and the valve seat of the nozzle device via transverse bores. These transverse bores preferably lead directly to the passage opening at the valve seat, so that unhindered inlet and guidance of the cooling medium through the passage opening is made possible in the open state.

The valve-closing element has outside a guided portion through the nozzle device a holding portion, on which an adjusting device is provided, which fixes the restoring device in relation to the nozzle device. This makes it possible for the nozzle device and the valve-closing element to be designed as a complete part for insertion into a housing. At the same time, the adjusting device makes possible fine adjustment of the opening time via adjustment of the prestressing force of a restoring device advantageously designed as a spring. The adjusting device is advantageously arranged displaceably on the holding portion. This can be brought about via a screw thread or via a sliding guide and a clamped connection or the like.

Furthermore, provision can advantageously be made that the valve-closing element has a sleeve with damping tongues which act on an inner wall of the inlet opening or outlet opening. By means of these damping tongues, vibration of the valve-closing element is prevented and the positioning movement effected by the differential pressure is at least slightly delayed, so that a calmed mass flow is achieved.

According to a preferred embodiment, the restoring device is designed as a spring element, in particular as a pressure-loadable spring element. This element is advantageously arranged coaxially with the valve-closing element. Alternatively, provision is likewise made as an advantageous embodiment that the restoring device is arranged adjacent to the valve-closing element or opposite the valve-closing element in order to achieve the self-holding closed position.

According to a further preferred embodiment of the invention, the closing force of the restoring device or the opening characteristic of the valve-closing element is determined according to the minimum required mass flow of the cooling medium as a function of the pressure difference present. By virtue of this, accurate setting of the opening time for the passage of the desired volume of the mass flow can be achieved.

The closing force of the restoring device or the opening characteristic of the valve-closing element is preferably determined according to a linear or curved function of the cooling medium flow over the present pressure difference.

This makes accurate design of the expansion valve possible. At the same time, the opening cross section of the passage opening can thus be determined as a function of the pressure difference, which in turn influences the geometry of the closing body and/or valve seat.

According to a further advantageous development of the invention, a compact construction is made possible by the design of the nozzle device and the valve-closing element accommodated by it. This leads to simple geometrical configurations of the housing and makes it possible for the inlet line and the outlet line to and from the expansion valve to be connected directly to the housing. The number of connection locations can thus be reduced and simplified.

According to the invention, the expansion valve can also be designed as a subassembly and consist of a nozzle, a closing body and a restoring device. This subassembly can for example be integrated in a connecting piece provided on the evaporator or in another location. Still further connection locations can thus be eliminated. For example, the nozzle can have releasable fastening elements, such as for example a screwed connection, on the outer periphery, so that easy mounting and exchange of the valve is made possible in a simple way.

According to a preferred development of the expansion valve according to the invention, a pressure-limiting valve is provided between the high-pressure-side inlet opening and the low-pressure-side outlet opening. This pressure-limiting valve serves as a bypass and makes it possible for a mass flow of the cooling medium to be conducted from the high-pressure side to the low-pressure side in a high-pressure range. This pressure-limiting valve in conjunction with the expansion valve has the advantage that rapid cooling of a heated space and consequently a cool-down function, in particular in a vehicle, is made possible. At the beginning of a cooling process, the expansion valve opens only slightly on account of a low differential pressure. On start-up of the cooling medium circuit, the cooling medium has a high density, so that a high mass flow is delivered for each revolution of the compressor. A rapid pressure increase thus takes place on the high-pressure side. By means of the pressure-limiting valve, however, the flowthrough of a high mass flow is made possible and a reduction of the overpressure on the high-pressure side is achieved. By virtue of this, the differential pressure before and after the valve-closing element of the expansion valve is increased at the same time, which in turn results in the expansion valve opening increasingly. A rapid cooling dynamic can consequently be achieved.

According to an advantageous development of the pressure-limiting valve, a cross-sectional area of a closing body of the pressure-limiting valve which can be acted on by the high-pressure side is designed to be larger, in particular considerably larger, than a cross-sectional area of the closing body or outlet opening of the pressure-limiting valve which can be acted on by low pressure. This makes it possible for the high-pressure side to constitute a reference variable for controlling the pressure-limiting valve and a low pressure prevailing on the low-pressure side to exert a small or an infinitely small influence on an opening movement of the closing body.

According to a further advantageous development of the pressure-limiting valve, a restoring device acting counter to the opening direction is provided and the opening pressure of the restoring device can be adjusted to a high pressure present on the high-pressure side. By virtue of this, the opening pressure can be adaptable to the cooling medium system concerned or the performance data of the cooling medium circuit for an optimum performance coefficient.

According to an advantageous development, the pressure-limiting valve can be adjusted to an opening pressure on the high-pressure side of between 80 bar and 120 bar. Particularly high cooling performance is thus achieved.

The preferred development of the pressure-limiting valve furthermore advantageously has a restoring device with a restoring element which, from an opening pressure, opens the opening cross section constantly with increasing mass flow of the cooling medium. By virtue of this, a low-noise and reduced-vibration configuration and start-up of a cooling medium circuit can be achieved. At the same time, a cooling medium circuit which can be operated in a controlled manner is produced by virtue of the preferably linear increase in the mass flow which results from the constantly opening opening cross section.

According to a further advantageous development of the pressure-limiting valve, the closing body of the pressure-limiting valve is designed as a spherical closing body which is arranged in a conical valve seat in a closed position, a sealing diameter formed by the bearing of the closing body in the valve seat being designed to be larger than an outlet opening in the outlet line. By virtue of the enlargement of the sealing diameter, influence of the low pressure on the opening of the pressure-limiting valve can be brought about and additionally simple limiting of the opening cross section can be achieved. By virtue of this, a shift of the opening characteristic of the pressure-limiting valve is achieved, a shift of the opening characteristic leading, as a function of the enlargement of the sealing diameter in relation to the outlet opening, to early opening of the pressure-limiting valve during the start-up of a cooling process. By virtue of this, rapid-response cooling can be achieved.

According to a preferred embodiment of the pressure-limiting valve, a spherical closing body which is arranged in a conical valve seat is provided, so that the closing body is arranged with its central point level with or below an upper edge of the valve seat facing the pressure space. By varying the inclination of the conical seat, different positions of the closing body in the valve seat can be achieved, smooth guidance of the closing body out of the valve seat being made possible. Extensive guidance of the closing body in the valve seat during opening can thus be afforded.

The valve seat of this advantageous development of the pressure-limiting valve is advantageously of conical design. This makes simple manufacture possible. The sealing diameter can be adapted as a function of the inclination of the conical valve seat, by virtue of which in turn the shift of the characteristic to lower opening pressures in relation to a preset opening pressure of the restoring device can be determined.

According to an alternative development of the valve seat of a preferred pressure-limiting valve, a stepped arrangement is produced, in which a stepped arrangement is provided between a conical seat for receiving the spherical closing body and the outlet opening, at least one cylindrical portion or a conical portion with a smaller degree of inclination than the conical valve seat for receiving the closing body being provided. By means of this alternative arrangement, a very great shift in terms of amount of the opening characteristic of the pressure-limiting valve for opening at lower high pressures can be achieved.

The preferably designed pressure-limiting valve is advantageously integrated in the housing of the expansion valve or arranged exchangeably on the housing. By integrating the pressure-limiting valve in the expansion valve, a compact construction is achieved. A pressure-limiting valve which can be connected exchangeably to a housing of the expansion valve makes retrofitting and also specific adaptation of the pressure-limiting valves to predetermined opening pressures possible.

BRIEF DESCRIPTION OF THE DRAWINGS

The invention and further advantageous embodiments and developments thereof are described and explained in greater detail below with reference to the example illustrated in the drawing. The features to be inferred from the description and the drawing can be applied according to the invention individually or together in any combination. In the drawing.

DETAILED DESCRIPTION OF THE INVENTION

Figure 1:
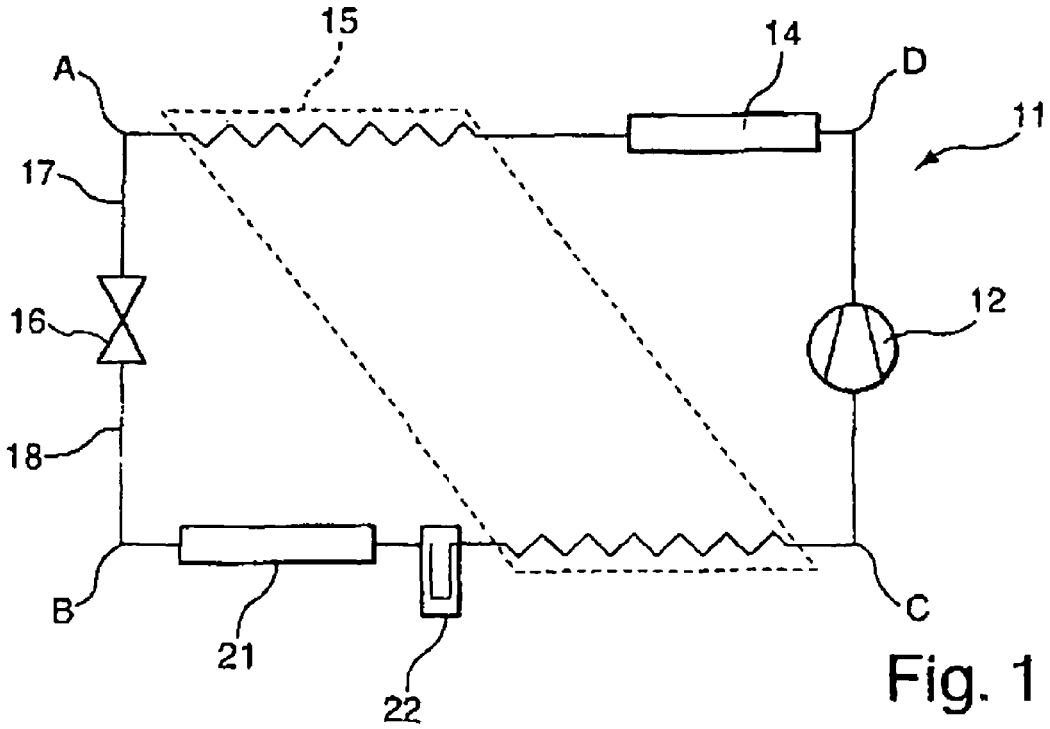
FIG. 1 shows a diagrammatic illustration of a cooling medium cyclic process.

FIG. 1 illustrates a cooling medium circuit 11, which is preferably operated with $CO_2$ as the cooling medium. A compressor 12 supplies the compressed cooling medium on the high-pressure side to an external heat exchanger 14. This communicates with the surrounding environment and gives heat off outwards. Connected downstream of this is an inner heat exchanger 15, which supplies the cooling medium to an expansion valve 16 via an inlet line 17. An inlet pressure, which may be 120 bar in summer and up to 70 bar in winter, is present on the high-pressure side before the expansion valve 16. The cooling medium flows through the expansion valve 16 and reaches the low-pressure side. On the outlet side, the expansion valve 16 has pressures of between 35 and 45 bar. The cooling medium cooled by the pressure relief passes via an outlet line 18 into the internal heat exchanger 21 and draws heat from the surrounding environment, by virtue of which the cooling of for example a vehicle interior is achieved. A collector 22 is connected downstream of the heat exchanger 21. The cooling medium in vapour form flows through the inner heat exchanger 15 and reaches the compressor 12.

Figure 2:
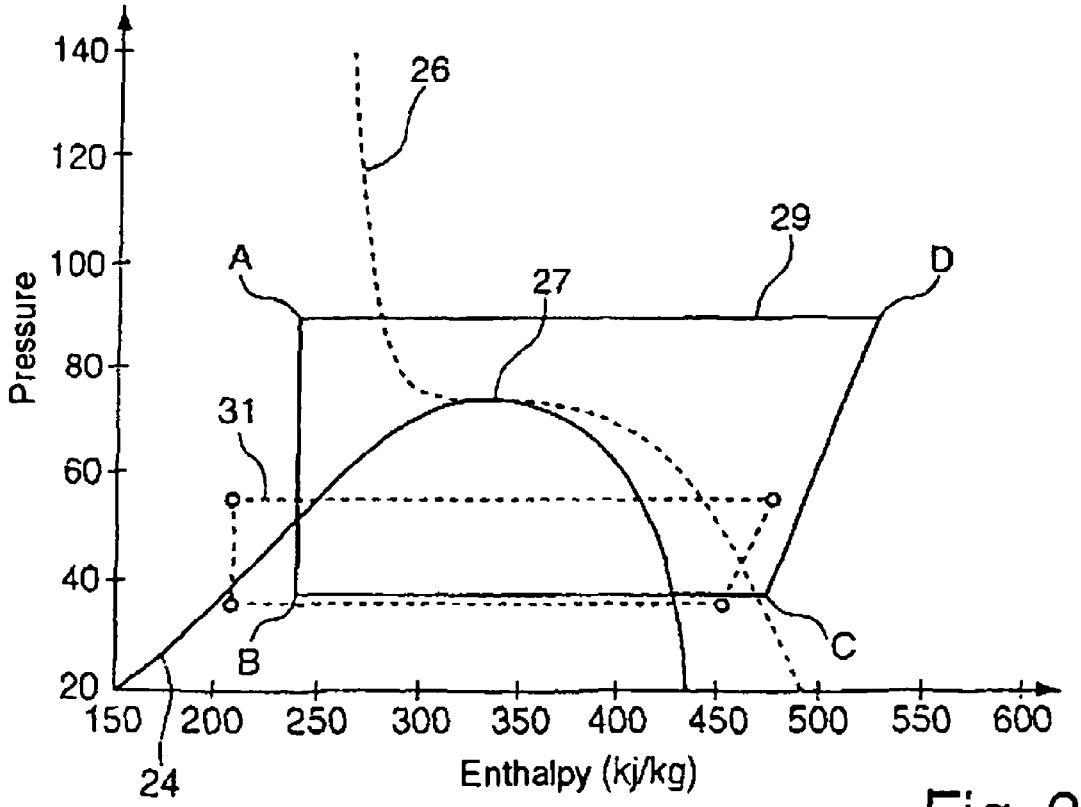
FIG. 2 shows an illustration of two cooling medium cyclic processes according to FIG. 1 in a Mollier diagram.

This cooling medium circuit according to FIG. 1 is illustrated in the Mollier diagram according to FIG. 2. In this diagram, the enthalpy h is plotted along the x axis, and the pressure of the cooling medium is illustrated on the y axis. The wet steam zone is enclosed by the line 24. In this area, the cooling medium evaporates. For orientation, the characteristic 26 is by way of example illustrated as an isotherm which corresponds to 31° C. The contact point of the lines 24 and 26 is the critical point 27, which for the cooling medium $CO_2$ for example corresponds to a temperature of 31° C. and a pressure of 73.8 bar. The solid line 29 shows the state of the $CO_2$ cooling medium during operation of the air-conditioning system in a transcritical process. The points A to D correspond to the states at the points A to D in FIG. 1. The dashed characteristic 31 shows the states of a cooling medium circuit according to FIG. 1 in a subcritical cyclic process.

Figure 3:
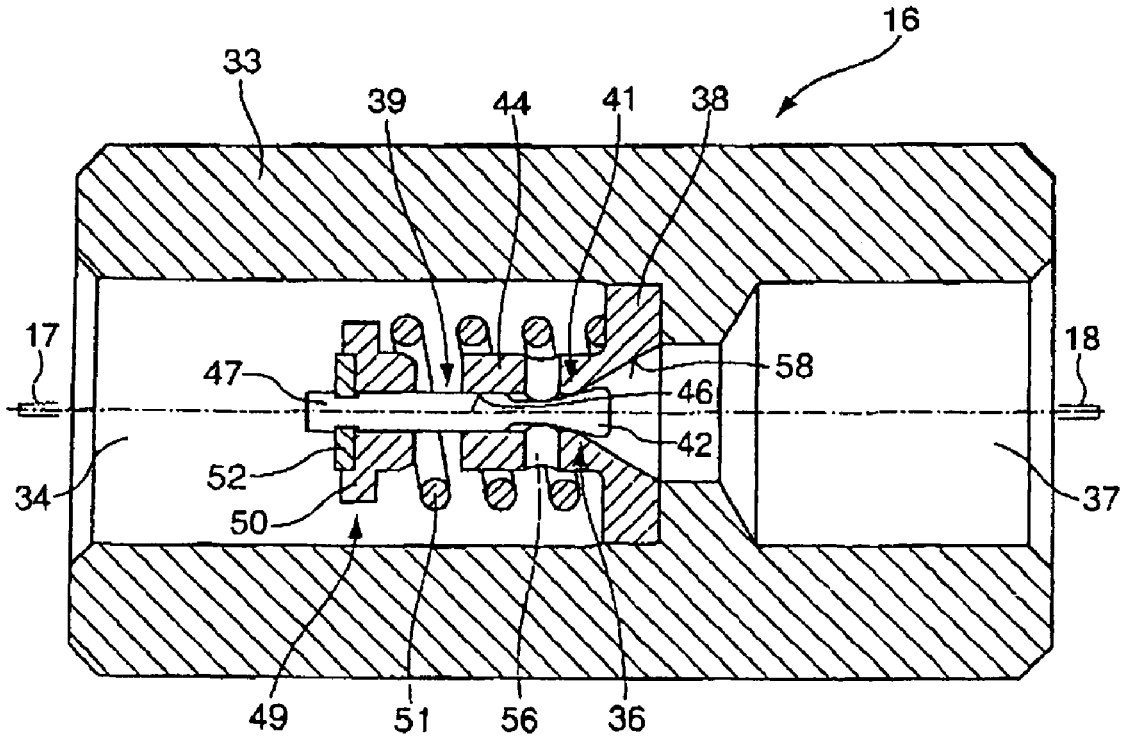
FIG. 3 shows a diagrammatic sectional illustration of an expansion valve according to the invention.

FIG. 3 shows a diagrammatic sectional illustration of an expansion valve 16 according to the invention. An inlet opening 34, which is connected to an outlet opening 37 via a through-opening 36, is provided in a valve housing 33. A nozzle device 38 is provided in the inlet opening 34. This nozzle device can be pressed in, bonded in, screwed or fastened by another means such as a screwed connection or clamped connection. The nozzle device 38 receives a valve-closing element 39 in the through-opening 36. A closing body 42 of the valve-closing element 39 is arranged on the outlet-pressure side in relation to the through-opening 36. On the inlet-pressure side or the high-pressure side, the valve-closing element 39 has a portion 46 which is guided by a guide portion 44 and adjoined by a holding portion 47. A restoring device 51 is arranged between the adjusting device 49 and the nozzle device 38. The adjusting device 49 comprises a disc-shaped element 50 with a shoulder, on which the restoring device 51 preferably designed as a compression spring is supported. The disc-shaped element 50 is fixed in relation to the holding portion 47 via a securing disc 52. The disc-shaped element 50 can be displaceable along the holding portion 47 as a function of the prestressing force to be set.

Between a valve seat 41 and the guide portion 44, the nozzle device 38 has transverse bores 56 which communicate with the through-opening 36. In the transition region between the through-bores 56 and the valve seat 41, the valve-closing element 39 is designed in a tapered manner in relation to the guided portion 46, so that the cooling medium reaches the through-opening 36.

The valve-closing element 39 has a conical closing body 42 which closes in an annular manner with a valve seat 41. The nozzle device 38 has a nozzle opening 58 which is widened in relation to the conical closing body 42.

The embodiment of the valve-closing element 39 illustrated in FIG. 3 makes possible self-centring positioning of the closing body 42 in relation to the valve seat 41. Furthermore, a simple and compact configuration is made possible.

To design an opening cross section between the closing body 42 and the valve seat 41 as a function of the travel of a valve-closing element 39, the procedure described below is followed, so that activation of the valve-closing element 39 is made possible owing to the pressure difference between the high-pressure side and the low-pressure side.

First, the optimally achievable cooling performance for the ambient temperature concerned is established. The ambient temperature concerned and the desired cooling performance can be determined by simulation using a cooling medium cyclic process according to FIG. 2, for example. The high pressure to be set optimally follows from the ambient temperature as the cyclic process regulation functions according to the principle of high-pressure regulation. From a circuit diagram according to FIG. 2 resulting therefrom, or from the simulation, the available enthalpy difference Δh between the points B and C, that is the inlet of the internal heat exchanger 21 and its outlet, can be determined. The required mass flow follows directly from the formula $m=Q_o/\Delta h$ (mass flow=cooling performance/enthalpy difference). From the thermodynamic variables, such as, according to point A, pressure before the expansion valve 16 and, point B, pressure after the expansion valve 16, and also the temperature before the expansion valve 16, the required opening cross section for the desired mass flow m can be determined. This opening cross section can consequently be transferred to the size of the through-opening or the valve seat 41 and the closing body 41. In particular the geometry of the closing body 42 is designed as a function of these values. At the same time, the opening force for the valve-closing element 49 is determined, so that the restoring device 51 brings about closing of the valve at least when pressure compensation takes place.

To optimize the high-pressure regulation, which is dependent on temperature, the valve opening cross section is maximized in relation to the performance coefficient. For design, reference is made to FIGS. 4*a*, 4*b* and 5.

Figure 5:
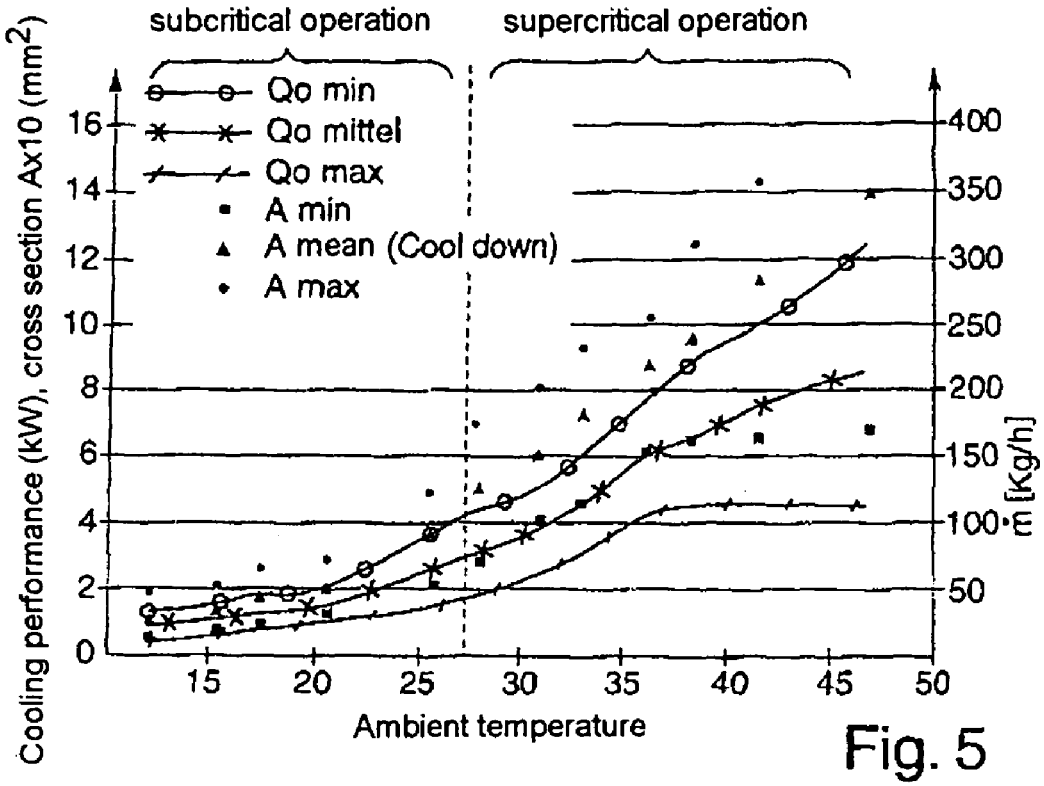
FIG. 5 shows a diagram which illustrates the cooling performance, the cooling medium mass flow and the valve opening cross section over the ambient temperature.

FIG. 5 shows a diagram in which the cooling performance $Q_o$, the valve opening cross section and the cooling medium mass flow are entered over the ambient temperature for a given system. For the ambient temperatures concerned, the minimum, the maximum and the arithmetic mean of the 3 parameter variables are also plotted. The maximum values are achieved during cooling of the vehicle, for example, and the minimum values during steady-state operation. The optimum high pressure of a $CO_2$ circuit exceeds the critical value of 73.8 bar above an ambient temperature of between 25 and 30° C.

Figure 4A:
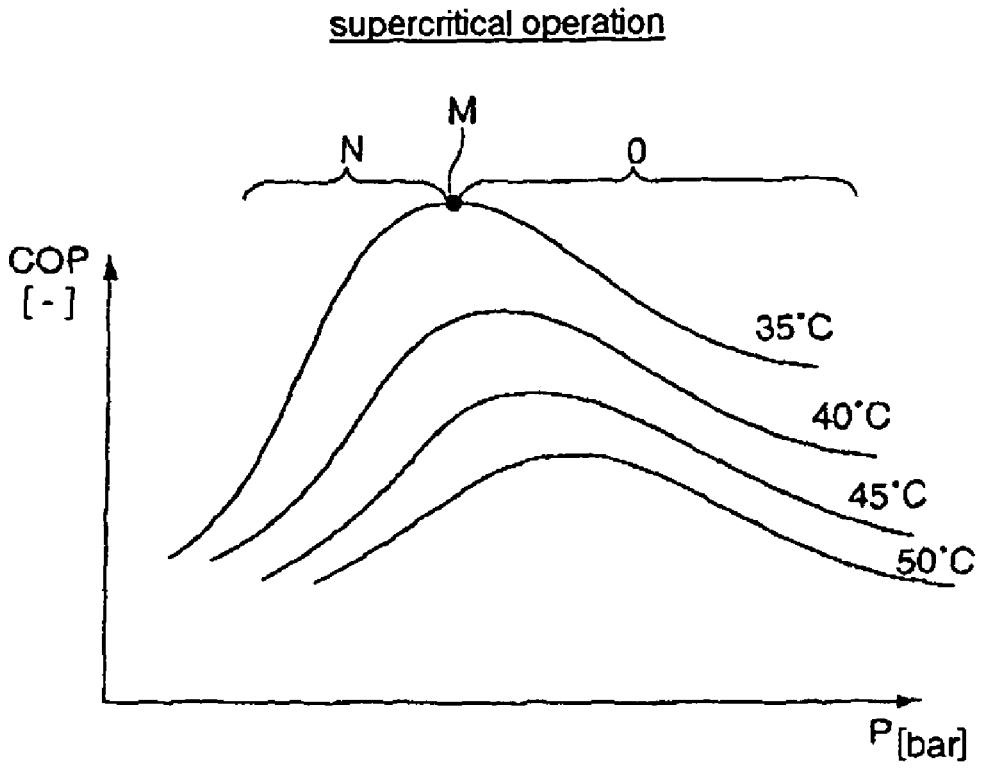
FIG. 4*a* shows a diagram which illustrates the relationship of the performance coefficient with the high pressure for supercritical operation as a function of the cooling medium temperature after an external heat exchanger.

FIG. 4*a* shows a diagram in which a characteristic depending on the cooling medium temperature after the external heat exchanger 14 is drawn as a function of the high pressure and of the performance coefficient. The optimum opening cross section for the cooling medium temperature concerned is given at a maximum M of the line. If the cross section is not optimally set, that is it is designed too large or too small, the performance coefficient worsens. In order to achieve an optimum operating mode, the cross section is designed for the maximum M or into a range O at least slightly. The range O shows that, while there is a reduction in the optimum COP, this is nevertheless accompanied by an increase in the high pressure. This range is more favourable for design than the range N is. This range N shows the relationships when the valve opening cross section is increased. This increase leads to a fall in the high pressure and the COP, so that the worsening of the COP is considerably more marked in this direction and consequently has a more unfavourable effect. A better result for the design of the entire range is achieved by virtue of the slower fall of the COP according to the range O.

Figure 4B:
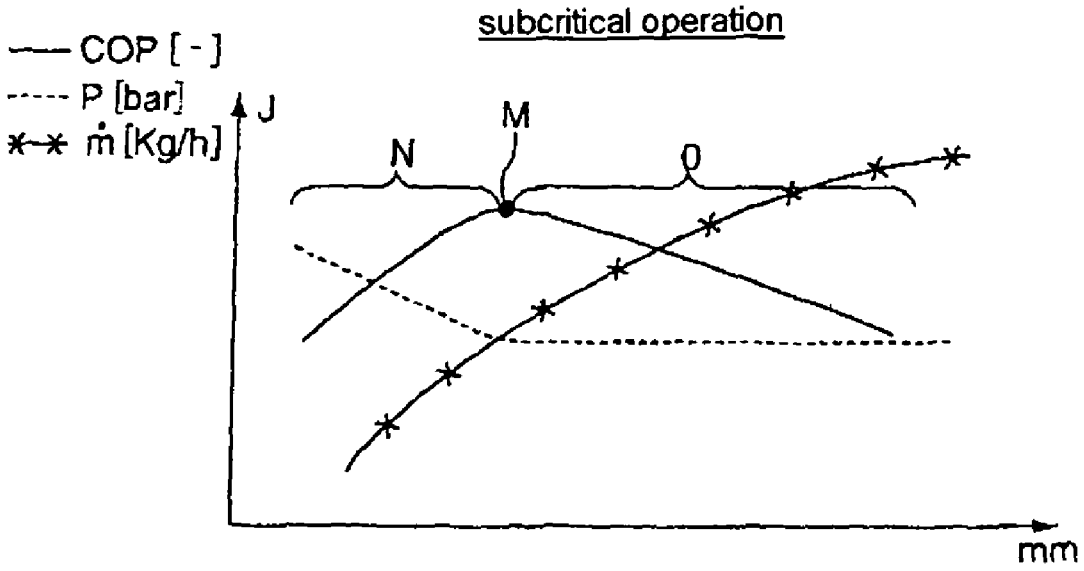
FIG. 4*b* shows a diagram which illustrates the relationship of a valve opening cross section with the performance coefficient, with the high pressure and with the cooling medium mass flow for subcritical operation.

In FIG. 4*b*, the parameters mass flow, performance coefficient COP and high pressure are plotted over the valve cross section for the subcritical operating cases. Here, in contrast to the diagram 4*a*, the parameters cannot be illustrated over the high pressure as the optimum performance coefficient cannot be assigned clearly to the high pressure. The diagram shows that, starting from the right side of the curves, closing of the valve brings about a continuous mass flow reduction at a given cooling performance. Over the range O, the high pressure remains constant but the performance coefficient COP increases constantly. The reason for this is that the compressor work behaves like the cooling medium flow in circulation as long as the high pressure/low pressure pressure difference to be overcome remains unchanged.

At the point M in FIG. 4*b*, the COP reaches its maximum and at this valve cross section the high pressure begins to rise. This operating point is consequently the optimum point for the air-conditioning system. In the range N to the left of the optimum point, the valve cross section decreases further and the high pressure rises further. As the compressor has to work through the now increasing pressure difference, the input power likewise rises. As a result, the COP falls very sharply.

Rules for designing the valve cross section as a function of the pressure difference present or for the cooling performances to be expected at different ambient temperatures can be inferred from FIGS. 4*a* and 4*b*.

In the subcritical range, the pressure differences to be set between the valve inlet and outlet sides are smaller than in supercritical operation. In order to achieve as great as possible a performance coefficient for the subcritical operating states, the valve cross section is set in such a way that the point M in FIG. 4*b* is achieved for a cooling performance to be expected which lies close to the maximum performance. By virtue of this, the valve cross section selected is slightly too large at smaller cooling performances. The COP fall is in this case smaller (range O) than for the range N.

In the supercritical operating case, a valve cross section reduction means that the high pressure rises further. As can be seen in FIG. 4*a*, the COP characteristic has in this direction a rate of fall which tends to be smaller than in the range N. Valve design for the supercritical operating cases is carried out for the or close to the smaller cooling performances to be expected at which an optimum high pressure assigned to the point M appears for the temperature concerned. With an increasing cooling performance requirement, the high pressure will rise further (range O) and a small COP reduction will occur.

The geometries of the closing body and of the valve seat are consequently, as illustrated above, designed for the subcritical and transcritical range. The opening or closing force of the restoring device is also taken into account.

The determination of the opening cross section results in the opening time of the valve-closing element 39, as well as the travel or opening travel of the valve-closing element 39 and consequently the opening cross section, being determined as a function of the pressure difference. A constructionally compact arrangement and design of an expansion valve 16, which operates with optimum high pressure at least partly, preferably over the entire range of application, can be produced without an additional electronic control.

Figure 6:
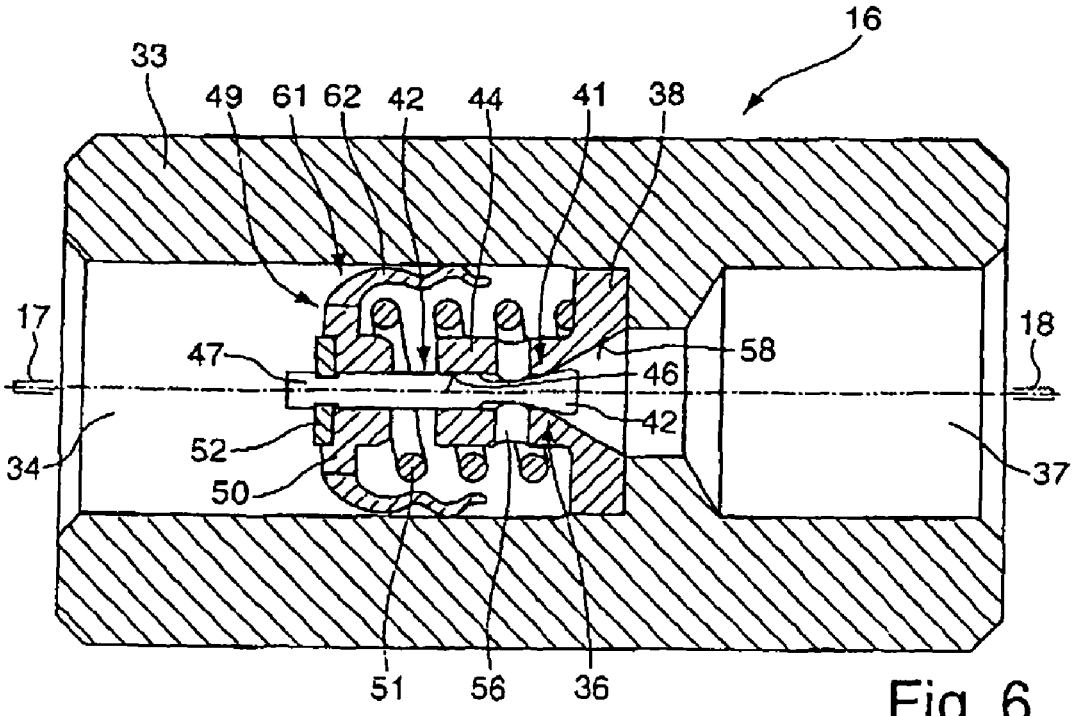
FIG. 6 shows a diagrammatic sectional illustration of an alternative embodiment of the expansion valve.

FIG. 6 illustrates an alternative development of an expansion valve 16 to FIG. 3. In this expansion valve 16, the adjusting device 49 comprises a sleeve 61 which can be flowed through by cooling medium and on which damping tongues 62 are designed. These damping tongues 62 slide on the inner wall of the inlet opening 34 and bring about a damped, at least slightly braked opening and closing movement of the valve-closing element 39. The sleeve 61 and the damping tongues 62 arranged thereon can also be arranged on the outlet-pressure side and be associated with the closing body 42.

Figure 7:
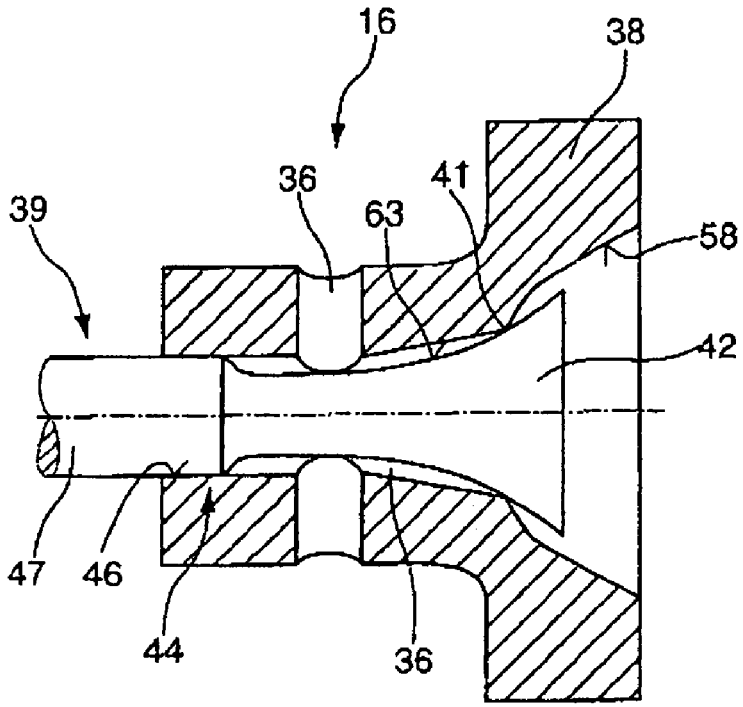
FIG. 7 shows a diagrammatically enlarged part view of an alternative embodiment of a valve-closing element.

FIG. 7 illustrates an enlarged detailed view of an alternative embodiment of a valve-closing element 39. The closing body 42 has as a closing surface a lateral surface which is curved inwards in relation to the longitudinal central axis of the valve-closing element 39. By virtue of this, opening cross sections adapted appropriately to the ambient temperatures can be achieved as a function of the geometry of the valve seat 41 and of the closing surface 63 adjoining it on the inlet-pressure side. The geometries of the closing body 42 and of the valve seat 41 can likewise also be designed with steps, with different inclinations, with conical surfaces and also on outwardly curved surfaces or the like.

Figure 8A:
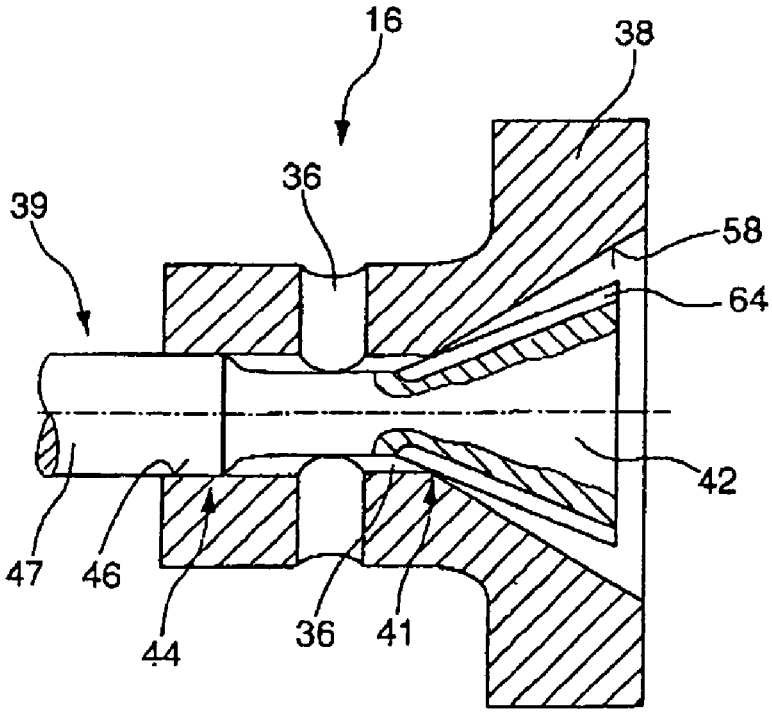
FIGS. 8*a* and *b* show diagrammatic enlarged sectional illustrations of a further alternative embodiment of a valve-closing element.
Figure 8B:
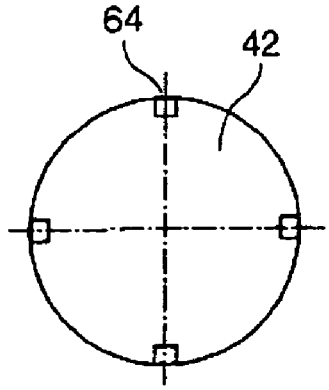

FIGS. 8*a* and *b* show an enlarged sectional illustration of a further alternative embodiment of a valve-closing element 39. At least one depression 64 is provided on the closing body 42, the effect of which is that a small mass flow of the cooling medium always flows through the through-opening 36. The valve-closing element 39 consequently opens only after a predetermined differential pressure is exceeded. The depressions 64 can be designed as rectangular grooves or as semicircular depressions or as recesses on the valve seat 41 and/or closing body 42, for example. Likewise, provision can alternatively be made for the closing body 42 not to come to bear against the valve seat 41 by the return travel or the closing travel being limited by a stop and a slightly open cross section consequently being provided.

Figure 9:
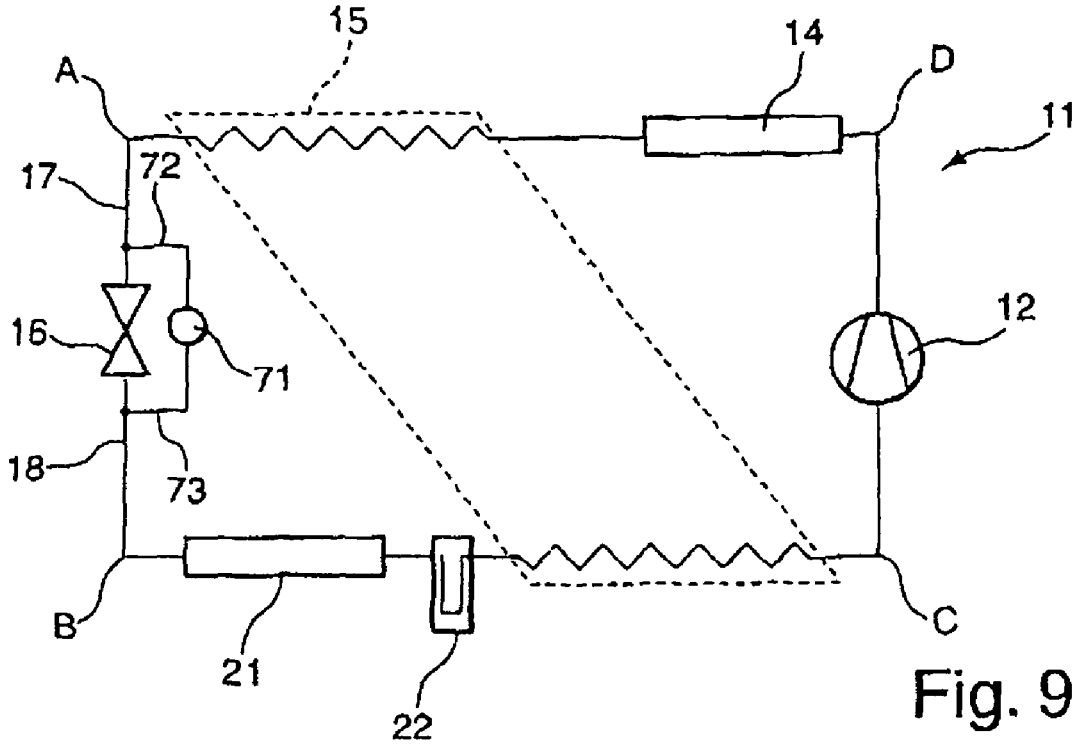
FIG. 9 shows a diagrammatic illustration of a cooling medium circuit with an expansion valve according to the invention, which comprises a pressure-limiting valve.

FIG. 9 illustrates a cooling medium circuit 11 which, with the exception of the expansion valve 16, corresponds to that in FIG. 1. The expansion valve 16 according to this advantageous embodiment comprises a pressure-limiting valve 71 which has an inlet line 72 on the high-pressure side which branches off from the inlet line 17 and an outlet line 73 on the low-pressure side which runs into the outlet line 18 of the expansion valve 16. By virtue of this arrangement, a high pressure present on the high-pressure side is provided as a reference variable for controlling the pressure-limiting valve 71. By virtue of this, opening and closing of the pressure-limiting valve 71 is determined essentially by the high pressure present on the high-pressure side.

Figure 10:
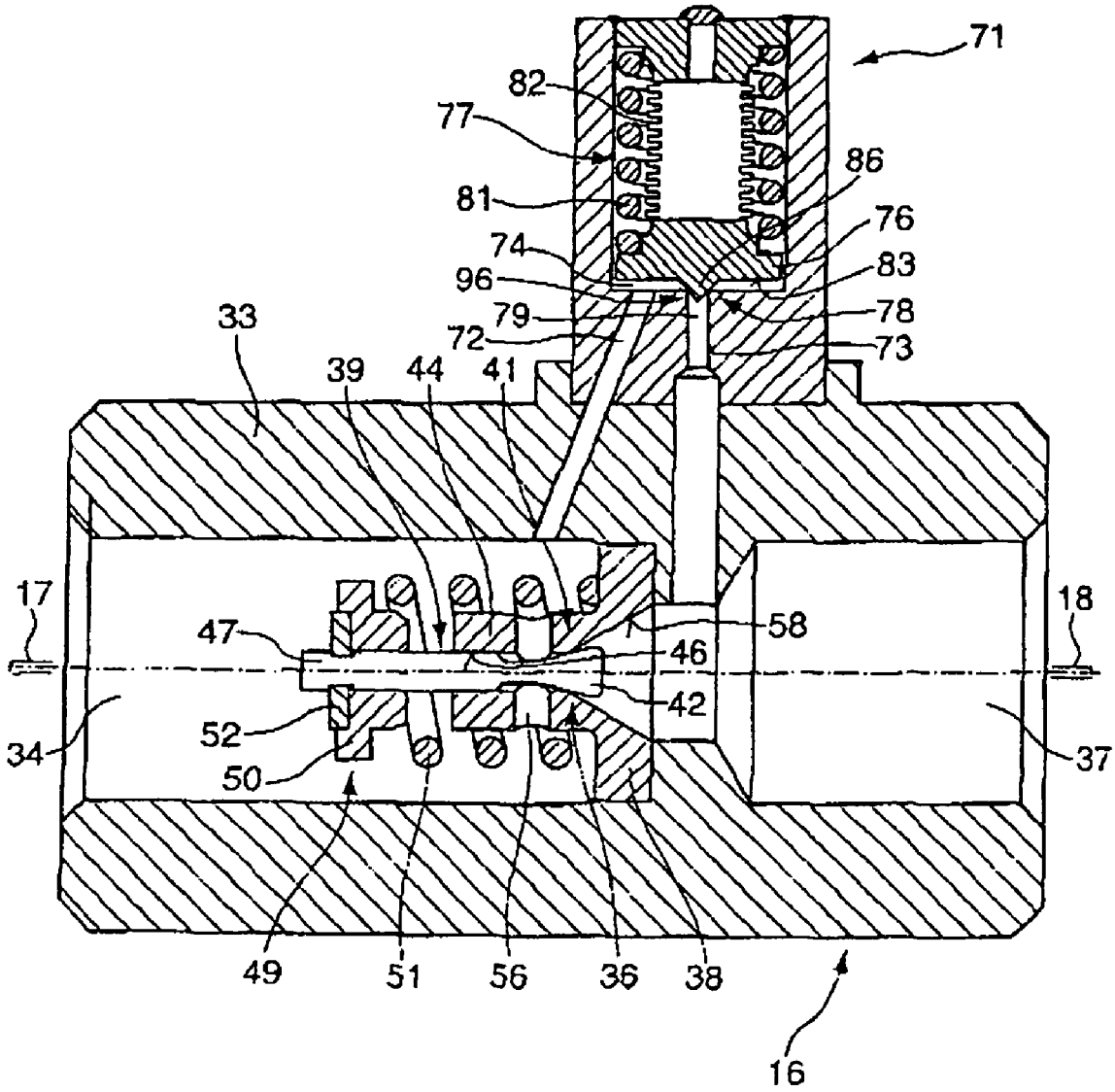
FIG. 10 shows a diagrammatic sectional illustration of an expansion valve according to the invention with a pressure-limiting valve.

In FIG. 10, an expansion valve 16 with a pressure-limiting valve 71 according to the diagrammatic illustration in FIG. 9 is represented in a sectional illustration. The pressure-limiting valve 71 is arranged laterally on the housing 33 of the expansion valve 16. The illustration according to FIG. 10 is not to scale. In most cases, the housing 33 of the expansion valve 16 is considerably smaller than the housing of the pressure-limiting valve 71.

In the illustrative embodiment according to FIG. 10, the pressure-limiting valve 71 is arranged exchangeably in relation to the housing 33 via a releasable connection. An embodiment which is not illustrated makes it possible for the pressure-limiting valve 71 to be integrated in the expansion valve 16 or vice versa.

An inlet line 72 branches off into the pressure-limiting valve 71 from an inlet opening 34 of the expansion valve 16 and runs into a pressure space 74 in which a closing body 76 is held in a closed position 78 via a restoring device 77. In this closed position 78, the closing body 76 closes an outlet opening 79 of the outlet line 73 which on the low-pressure side runs into the outlet line 37 of the expansion valve 16.

According to the illustrative embodiment shown in FIG. 10, the restoring device 77 comprises a spring element 81 and a bellows 82, the interior of which can be filled with a gas, in particular helium. The bellows 82 advantageously serves for screening a region of the rear side of the closing body 76 off in relation to the pressure space 74. This ensures that in the closed position 78 illustrated of the closing body 76 a comparatively large area of the closing body 76 is acted on by the high pressure in the opening direction of the closing body 76 counter to the force of the spring element 81. The gas filling of the bellows 82 is advantageously set to a low bellows internal pressure, so that any temperature changes and associated changes in the internal pressure in the bellows 82 can exert only a small influence on the closing behaviour of the closing body 76 in comparison with the closing force of the spring element 81.

Provision can alternatively be made for a diaphragm, which delimits the pressure space 74 in relation to the atmosphere, to be provided instead of the bellows 82. The spring element 81 can be located inside or outside the pressure space 74 delimited by the diaphragm.

A further alternative embodiment proposes that only one or more spring elements 81 are arranged parallel and/or one behind another in order to achieve a desired opening characteristic.

The opening characteristic depends furthermore on the ratio of the cross-sectional area 83 of the closing body 76 which can be acted on by high pressure and the low-pressure-side cross-sectional area, which follows from the size of the outlet opening 79. The cross-sectional area 83 is designed to be larger, in particular considerably larger, than the area of the outlet opening 79, so that the pressure-limiting valve 71 operates virtually independently of the pressure on the low-pressure side.

The branching of the inlet line 72 to the pressure-limiting valve 71 off from the inlet opening 34 and the running of the outlet line 73 into the outlet opening 37 of the expansion valve 16 are only examples and can be adapted as a function of the geometry of the expansion valve 16 and/or of the pressure-limiting valve 71.

According to the illustrative embodiment, the closing body 76 has a conical valve body 86, which engages at least partly in the outlet opening 79 and closes the opening. When the pressure-limiting valve 71 is acted on, the valve body 86 opens the outlet opening 79 constantly, by virtue of which a controlled opening of the cross section of the outlet opening 79 is brought about when the cross-sectional area 83 of the closing body 76 is acted on and a constant opening characteristic is achieved.

Figure 11:
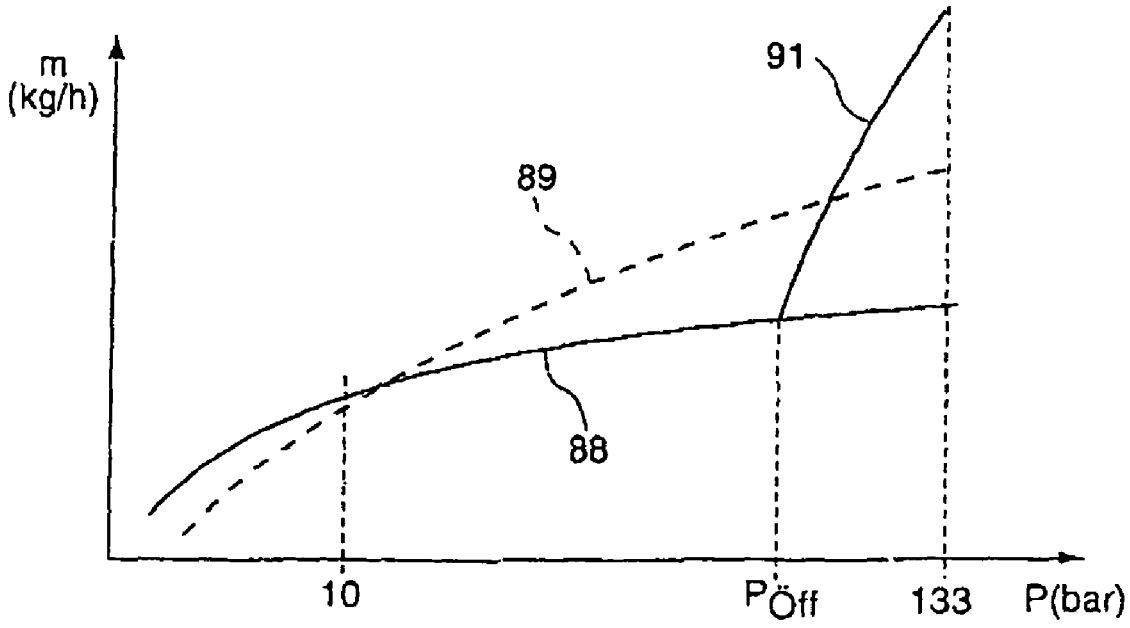
FIG. 11 shows a diagram which illustrates the cooling medium mass flow over the high pressure present at the expansion valve.

FIG. 11 shows a diagram in which the mass flow is illustrated over the pressure on the high-pressure side of the expansion valve 16. A characteristic 88 shows by way of example a rise in the mass flow with increasing high pressure through a fixed throttle with a fixed cross-sectional opening. The mass flow increases only slightly in a range between 10 bar and 80 bar, for example.

A characteristic 89 illustrated by a dashed line shows the increase in the mass flow with rising high pressure in an expansion valve 16, which is already considerably improved in relation to the characteristic 88. By virtue of the arrangement of the pressure-limiting valve 71, the mass flow is increased considerably from a predetermined opening pressure $P_{Off}$ by the opening of the pressure-limiting valve 71, as is illustrated by a characteristic 91, which results in a high cooling dynamic. The opening characteristic 91 preferably has a linear rise, as rectilinear as possible a shape of the opening characteristic being desired in particular in a range directly before 133 bar. This accelerates the cyclic process, by virtue of which the pressure difference between the high-pressure side and the low-pressure side rises. At the same time, a pressure increase on the high-pressure side is prevented from exceeding a critical value of 133 bar, which constitutes an upper limit value for safety reasons.

Figure 12:
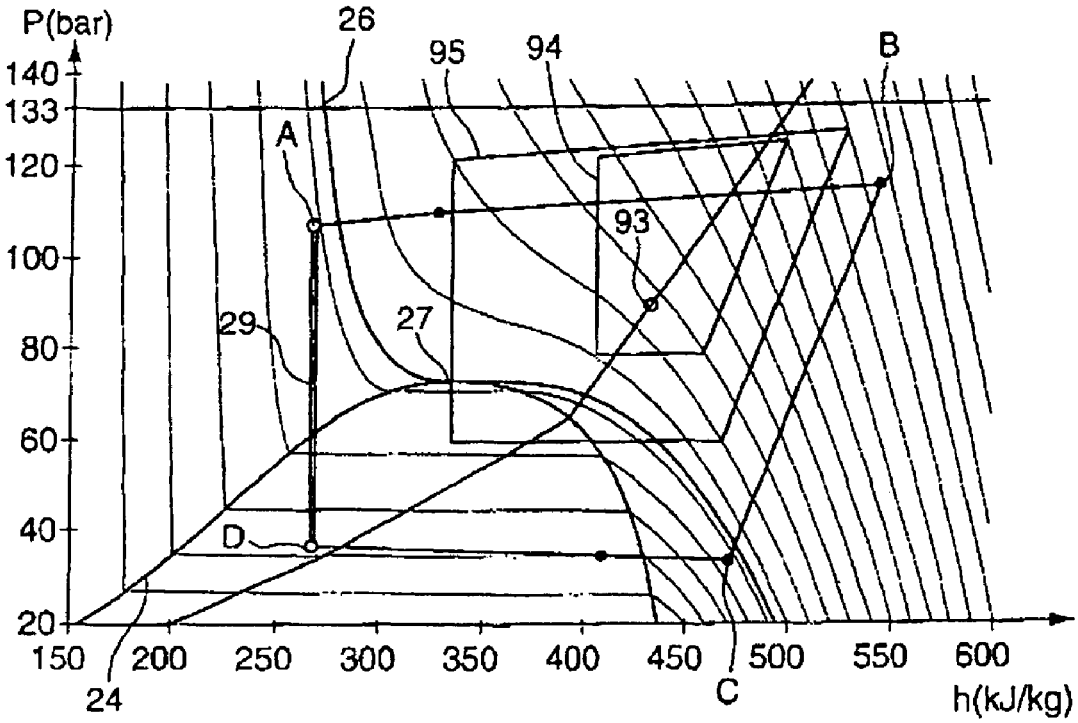
FIG. 12 shows a diagram of a cooling medium cyclic process at the beginning of cooling in a Mollier diagram.

Such a start-up phase of a cyclic process is illustrated in a Mollier diagram in FIG. 12, for example. At the beginning of cooling of a vehicle which has heated up in summer, for example, the cyclic process of a cooling medium system begins at point 93. The compressor 12 delivers cooling medium, which results in a rapid rise in the high pressure on the high-pressure side. By virtue of the pressure-limiting valve 71 opening, the mass flow increases rapidly. As a result, more heat can be absorbed at the evaporator, and an anti-clockwise cyclic process becomes, via the unsteady operating phases 94 and 95 illustrated by way of example, a steady-state process which corresponds to the points A to D, as is described in greater detail in FIG. 2.

Figure 13A:
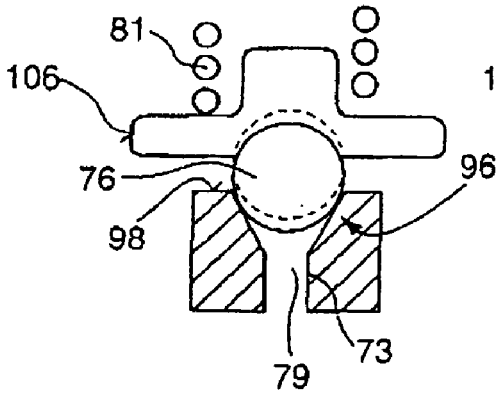
FIGS. 13*a* and *b* each show a diagrammatic sectional illustration of a valve seat of the pressure-limiting valve.

FIG. 13*a* shows a diagrammatic sectional illustration of an alternative embodiment of a spherical closing body 76, which is arranged in a conical valve seat 96 in a closed position 78. In the closed position 78, a sealing diameter, which is formed by the bearing of the closing body 76 in the valve seat 96, is designed to be greater than an outlet opening 79 in the outlet line 74. As a result, the low pressure acting on the closing body 76 increases by virtue of an enlarged area corresponding to the sealing diameter. The effect of this is described in greater detail in FIG. 14. In this embodiment, a central point of the spherical closing body 76 lies above an upper edge 98 of the valve seat 96. Lateral guide portions 106 are provided for guiding the closing body 76 during opening and closing.

Figure 13B:
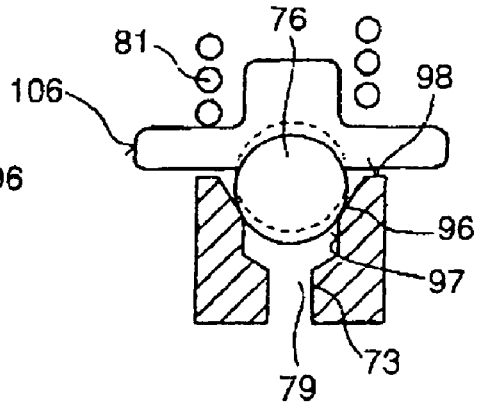

FIG. 13*b* illustrates an alternative embodiment to FIG. 13*a*. The conical valve seat 96 has a cylindrical portion 97, which is adjoined by a conical transition portion which runs into the outlet opening 79 of the outlet line 73. In this development, a central point of the closing body 76 is provided below an upper edge 98 of a valve seat 96 facing the pressure space 74. Alternatively, the sphere centre or the central point of the closing body 76 can be provided at the same level. By virtue of this, the closing body 76 remains in contact with the valve seat 96 during opening and closing and is guided along a generator.

Figure 14:
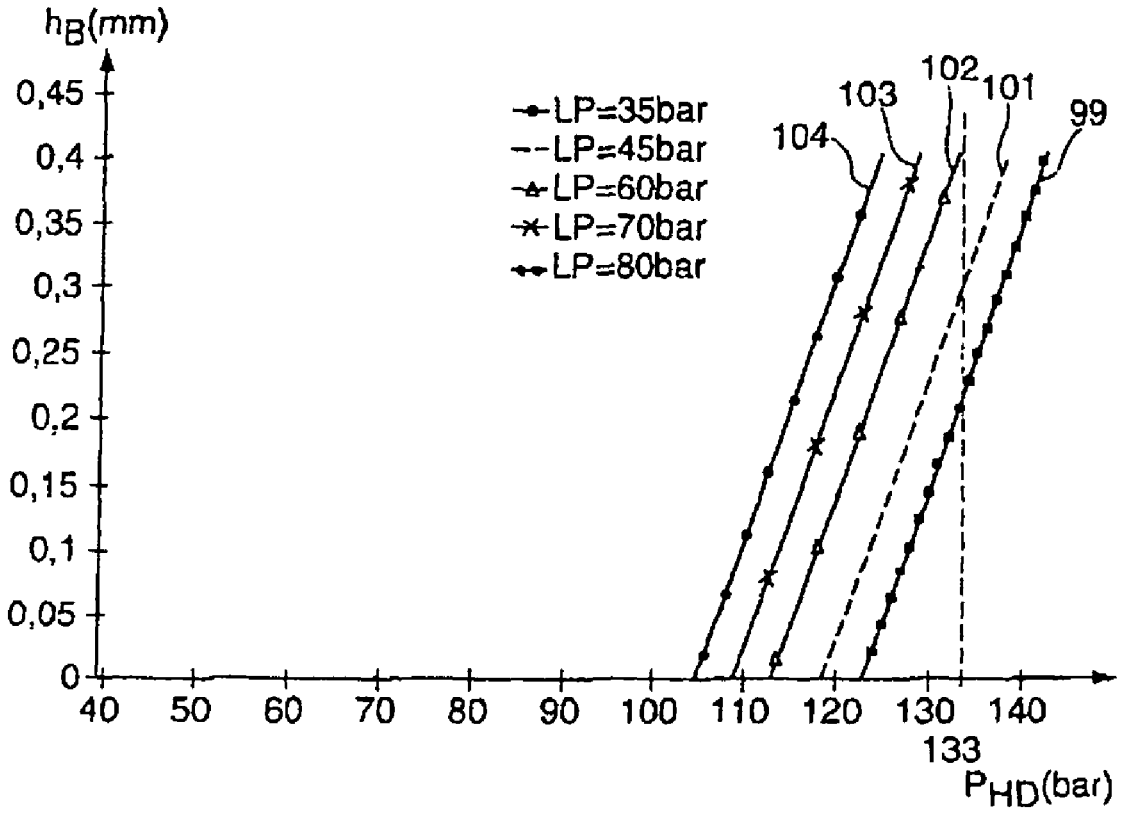
FIG. 14 shows a diagram which illustrates opening characteristics of the pressure-limiting valve as a function of a low pressure on a low-pressure side of the expansion valve.

FIG. 14 shows a diagram which illustrates opening characteristics of different low pressures in the relationship of a high pressure with the working lift of the closing body 76 of the pressure-limiting valve 71. A maximum lift movement may comprise 0.3 mm or 0.5 mm out of the valve seat 96, for example. In a parked vehicle in summer, which has heated up, a standstill pressure of up to 90 bar prevails in the $CO_2$ air-conditioning system. At the beginning of the cooling medium cyclic process, the pressure-limiting valve 71 opens owing to the high low-pressure value at a high pressure of 105 bar, for example, which results in the opening line 104. By virtue of this, a higher mass flow for rapid cooling is achieved, and the pressure remains below the maximum permissible high pressure of 133 bar. The cooling medium pressure at the valve outlet 37 decreases, as does also as a result the influence of this pressure on the closing body 76 of the pressure-limiting valve 71. Consequently, the opening characteristic of the pressure-limiting means 71 is shifted (characteristics 103, 102, 101, 99). This ensures that in steady operating states, that is when the low pressure in the outlet line 18 lies between 35 bar and 45 bar, the opening point of the pressure-limiting valve 71 lies at a high pressure level of 120 bar, for example, which is necessary for efficient system operation.

The features and embodiments described in connection with the illustrative embodiments are in each case essential to the invention and can be combined with one another as required.

The invention claimed is:

1. Expansion valve in particular for vehicle air-conditioning systems operated with $CO_2$ as the cooling medium, with a valve housing which has an inlet opening and an outlet opening, with a valve-closing element which closes a valve seat of a through-opening which is arranged between the inlet opening and the outlet opening, and with a restoring device acting in a closing direction of the valve-closing element, characterized in that the valve-closing element is moved in an opening direction counter to a force of the restoring device by an opening force which results from a pressure difference between an inlet pressure of the inlet opening and an outlet pressure of the outlet opening and characterized in that a pressure-limiting valve is provided between a high-pressure-side inlet opening and a low-pressure-side outlet opening of the valve housing.

2. Expansion valve according to claim 1, characterized in that a cross-sectional area of a closing body of the pressure-limiting valve, which is acted on by high pressure, is designed to be larger, than a cross-sectional area of an outlet opening of the pressure-limiting valve which is acted on by low pressure.

3. Expansion valve according to claim 1, characterized in that the pressure-limiting valve has a restoring device acting counter to the opening direction of a closing body and the opening pressure of the restoring device is adjusted to a high pressure present on the high-pressure side.

4. Expansion valve according to claim 1, characterized in that the pressure-limiting valve is adjusted to an opening pressure on the high-pressure side of between 80 and 120 bar.

5. Expansion valve according to claim 3, characterized in that the restoring device has at least one restoring element which acts on the closing body and the closing body, from a preselected opening pressure Popen, opens the opening cross section of an outlet opening constantly with increasing pressure of the cooling medium on the high-pressure side.

6. Expansion valve according to claim 1, characterized in that the pressure-limiting valve is integrated in the housing of the expansion valve or arranged exchangeably on the housing in relation to inlet and outlet lines.

7. Expansion valve according to claim 1, characterized in that a required mass flow of the cooling medium flowing through the through-opening for operation of the cooling medium circuit with optimum high pressure is determined from the inlet pressure in the inlet opening, the outlet pressure in the outlet opening and the temperature before the valve-closing element, from which the required opening cross section is derived.

8. Expansion valve according to claim 1 characterized in that the opening direction of the valve-closing element is provided in the flow direction of the cooling medium.

9. Expansion valve according to claim 1, characterized in that the valve-closing element has a closing body which is provided on the outlet-pressure side in relation to the valve seat and extends on the inlet-pressure side through the through-opening.

10. Expansion valve according to claim 1, characterized in that the valve-closing element has a closing body with a conical closing surface, a convexly or concavely curved lateral surface as a closing surface or a conical closing surface stepped with at least two different inclinations.

11. Expansion valve according to claim 1, characterized in that a closing body is surrounded by a nozzle opening of a nozzle device, which has a greater opening width than a peripheral surface of the closing body.

12. Expansion valve according to claim 1, characterized in that the valve-closing element is guided in a nozzle device by a guide portion and the valve seat is arranged opposite the latter.

13. Expansion valve according to claim 12, characterized in that at least one transverse bore, which connects the inlet opening to the through-opening, is provided in the nozzle device between the guide portion and the valve seat.

14. Expansion valve according to claim 1, characterized in that an adjusting device, which acts on the valve-closing element and fixes the restoring device in relation to the nozzle device, is provided outside a guided portion of the valve-closing element.

15. Expansion valve according to claim 1, characterized in that the adjusting device is arranged displaceably along a holding portion of the valve-closing element.

16. Expansion valve according to claim 1, characterized in that the restoring device is designed as a spring element, which is arranged coaxially with or adjacent to the valve-closing element.

17. Expansion valve according to claim 1, characterized in that at least a closing force of the restoring device or the opening characteristic of the valve-closing element is determined according to the minimum required cooling medium mass flow for a transcritical range and according to the maximum required cooling medium mass flow for a subcritical range and at least the closing force of the restoring device or the opening characteristic of the valve-closing element is determined according to a linear or curved function of the cooling medium flow.

18. Expansion valve according to claim 1, characterized in that the inlet and outlet openings of the valve housing are connected directly to an inlet line and outlet line.

19. Method for controlling an expansion valve, in particular for vehicle air-conditioning systems operated with $CO_2$ as the cooling medium, with a valve housing, in which on a high-pressure side an inlet pressure is present in an inlet opening and on a low-pressure side an outlet pressure is present in an outlet opening, with a valve-closing element which is moved in an opening direction out of a valve seat of a through-opening, which is arranged between the inlet opening and the outlet opening, for the flowthrough of the cooling medium, characterized in that, as a function of a size of a pressure difference between the inlet pressure of the inlet opening and the outlet pressure of the outlet opening, a section of the opening or closing movement of the valve-closing element is controlled via a range which is to be regulated at least partly.

20. Method according to claim 19, characterized in that an opening cross section between the valve-closing element and the valve seat changes continuously as a function of the pressure difference.

21. Method according to claim 19, characterized in that the valve-closing element is held in the valve seat when a pressure compensation takes place.

22. Method according to claim 19, characterized in that an opening time for the through-opening is set by a restoring device acting counter to the opening direction of the valve-closing element.

23. Method according to claim 19, characterized in that an adjusting device acting on the valve-closing element and receiving the restoring device is displaced along a holding portion of the valve-closing element for adjustment of the opening time.

* * * * *